US006077362A

United States Patent [19]

Reed

[11] Patent Number: 6,077,362

[45] Date of Patent: Jun. 20, 2000

[54] PORTABLE FECES DISPERSAL DEVICE

[76] Inventor: William Mark Reed, 2925 Coral Shores Dr., Ft. Lauderdale, Fla. 33306

[21] Appl. No.: 09/096,299

[22] Filed: Jun. 11, 1998

[51] Int. Cl.[7] ..... B08B 3/02

[52] U.S. Cl. ..... 134/34; 134/42; 134/198; 134/201

[58] Field of Search ..... 134/198, 201, 134/42, 39; 111/7.1; 241/41, 168; 239/154, 288, 288.3, 288.5; 222/278

[56] References Cited

U.S. PATENT DOCUMENTS

| | | | |
|---|---|---|---|
| 1,979,541 | 11/1934 | Gunn . | |
| 2,528,927 | 11/1950 | Vose . | |
| 2,589,020 | 3/1952 | North, Jr. | 299/111 |
| 2,841,923 | 7/1958 | Dickison | 47/1 |
| 2,928,610 | 3/1960 | Fenimore . | |
| 3,464,629 | 9/1969 | Peters | 239/104 |
| 3,740,086 | 6/1973 | Rossitto . | |
| 3,753,408 | 8/1973 | Zimmerman . | |
| 3,770,204 | 11/1973 | Schuster . | |
| 3,921,582 | 11/1975 | Sedlmeir . | |
| 3,936,002 | 2/1976 | Geberth, Jr. . | |
| 3,968,937 | 7/1976 | Miller . | |
| 4,042,269 | 8/1977 | Skermetta . | |
| 4,117,555 | 10/1978 | Dennis . | |
| 4,192,462 | 3/1980 | Erickson | 239/288 |
| 4,302,040 | 11/1981 | Lazar | 294/19 R |
| 4,432,498 | 2/1984 | Clements . | |
| 4,485,971 | 12/1984 | Pajevic . | |
| 4,600,149 | 7/1986 | Wakatsuke . | |
| 4,744,380 | 5/1988 | Sheriff | 134/198 |
| 4,863,108 | 9/1989 | Mitchell . | |
| 4,957,131 | 9/1990 | Robinson | 134/175 |
| 4,997,111 | 3/1991 | Lowers . | |
| 5,029,758 | 7/1991 | Chayer . | |
| 5,331,985 | 7/1994 | Lyons | 134/66 |
| 5,433,278 | 7/1995 | Shipley | 172/370 |
| 5,889,275 | 3/1999 | Chen . | |

*Primary Examiner*—Frankie L. Stinson
*Attorney, Agent, or Firm*—Law Offices of Brian S. Steinberger; Brian S. Steinberger

[57] ABSTRACT

A portable device having a shoulder strap for mashing and dispersing feces type material. The device includes a cylindrical chamber that is filled with liquid such as water, disinfectants, fragrances, soapy water, detergents, and the like. The liquid in the chamber is pressurized by a handpump, air compressor, electrical compressor, pressurized cartridge and the like. A nozzle having an adjustable spray pattern connects to the outlet port of the chamber. When activated, a switch on the chamber allows the pressurized contents in the chamber to pass through the nozzle. Attached to a lower end of the chamber is a conical shroud having plural rods across the interior of the wide diameter end. When the shroud is placed over clump material such as animal feces, the rods break up and separate the material. The shroud abuting against the ground forms a sealed housing so that released spray from the nozzle into the shroud housing disperses the broken up clump material into the surrounding dirt and grass ground surfaces. The top end of the shroud can have an accordion connector allowing the shroud to pivot and bend in relation to the chamber.

19 Claims, 2 Drawing Sheets

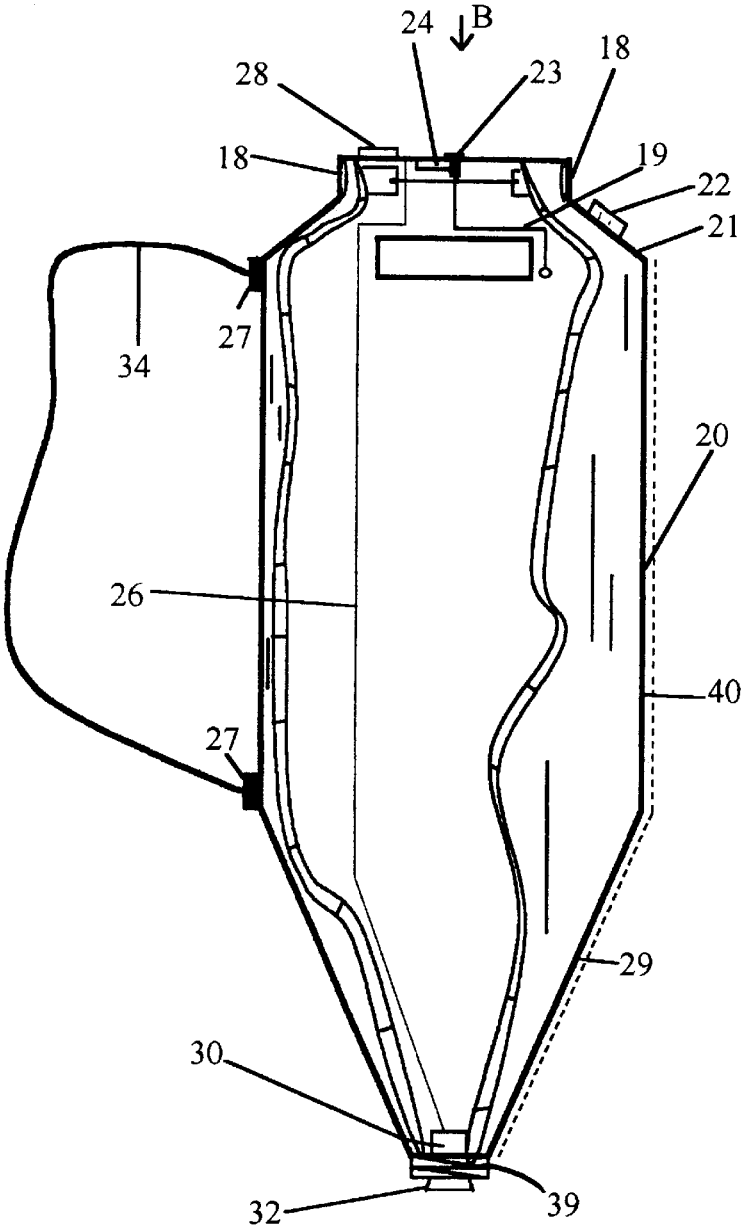
Fig. 1 A
Fig. 1B
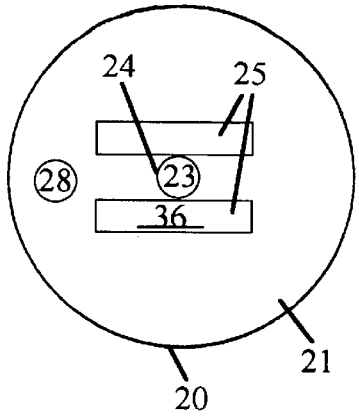
Fig. 1C
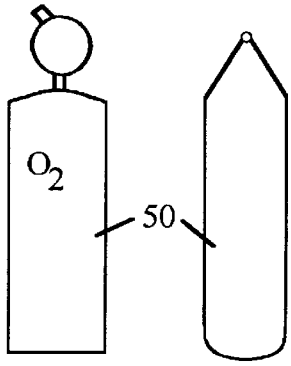
Fig. 1D
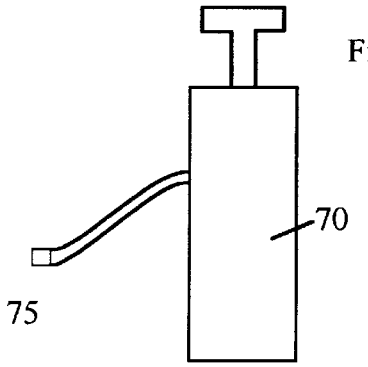

PORTABLE FECES DISPERSAL DEVICE

This invention relates to waste disposal, and in particular to an apparatus for breaking up, liquifying and dispersing animal feces and bird droppings.

BACKGROUND AND PRIOR ART

Many urban communities such as major metropolitan areas have laws that require pet owners to dispose of pet feces. Home owners with pets have the problem with feces accumulating overtime. Excessive feces are a sanitary hazard and a public nuisance.

To solve these problems most pet owners have resorted to carrying plastic bags. However, the person has to bend over/kneel and physically scoop up the feces. This undesirable squatting exposes persons performing this function to embarrassment, unpleasant odors, mess, bacterial risks, and the problem as to where to discard the remnants.

Several pressurized water source patents have been proposed in this area but fail to solve the problems presented above. U.S. Pat. No. 4,302,040 to Lazar; U.S. Pat. No. 4,744,380 to Sheriff; and U.S. Pat. No 4,957,131 to Robinson describe water jet type cleaning attachments. These attachments generally require connections to pressurized fixed water hose type connections limiting their use. Thus, these devices are not portable. Furthermore, these devices would not be useful in environments that do not have pressurized water supplies, such as parkgrounds and camps. Their bulky longitudinal housings would also be difficult to both carry and manipulate when needed.

Other types of bulky devices have also been proposed such as shovel scoopers named "pooper scooper" such as the one described in U.S. Pat. No. 5,290,080, and the "earth clod chopper" described in U.S. Pat. No. 5,433,278 to Shipley. However, these shovels and choppers are not easily portable, require direct contact with excrement and must be cleaned after use. Both equipment require handling the feces to a final disposal container. Furthermore, each of these tools require the user to have some physical dexterity and coordination in order to be used. Furthermore, the shovels and choppers will inherently expose the user to the full odor and mess of handling excrement.

SUMMARY OF THE INVENTION

The first objective of the present invention is to provide a portable easy to carry device to liquify and disperse waste material such as feces.

The second object of this invention is to provide a a portable device to liquify and disperse waste material that is formed from light, sturdy composite materials.

The third object of this invention is to provide a portable device to liquify and disperse waste material that eliminates one from physically handling the waste material.

The fourth object of this invention is to provide a portable device to liquify and disperse waste material that eliminates the problem of where to dispose of solid waste material.

The fifth object of this invention is to provide a portable device to liquify and disperse waste material which minimally contacts the waste material and does not need extensive cleaning after being used.

The sixth object of this invention is to provide a portable device to liquify and disperse waste material that virtually eliminates the odors from the solid waste materials.

The seventh object of this invention is to provide a portable device to liquify and disperse ground based waste material which eliminates most bending and crouching by the user.

A preferred embodiment of the portable apparatus includes a main cylindrical chamber for housing a pressurized liquid having an exit port, and a mechanical switch on the chamber for releasing the pressurized liquid to a nozzle. The chamber can be hand carried to remote sites using a shoulder strap. A cap on an inlet port allows liquid such as but not limited to water, disinfectant agents, soap, detergent, antibacterial fluids and the like, to refill the chamber when needed. Fill valves on the chamber allow the liquid contents to be pressurized by a hand or foot pump, an electrical compressor, an air cylinder, and the like. The nozzle end of the chamber can be adjustably rotated to release the pressurized liquid in selected spray patterns. A conical shroud having a top narrow open end and a bottom expansive open end, can be attached by the former to the nozzle of the chamber, by mateable threads. An accordion like expandable and bendable connector can be used allowing the conical shroud to bend and pivot relative to the chamber. Inside the bottom open end of the conical shroud can be a cross pattern of flange rods which when placed over ground based clump material separates the clump material into pieces. Activating the switch releases the pressurized liquid into the conical shroud liquifying the broken up clump material and dispersing the remnants into the surrounding earth ground surface. The device can be used on clump material such as waste material chosen from animal feces and bird droppings, mud and other materials that can be broken up and liquified.

Further objects and advantages of this invention will be apparent from the following detailed description of a presently preferred embodiment which is illustrated schematically in the accompanying drawings.

BRIEF DESCRIPTION OF THE FIGURES

FIG. 1A is a side view of the main body of the novel feces dispersal device of the subject invention.

FIG. 1B is a top view of the main body of FIG. 1A along arrow B.

FIG. 1C shows an electrical compressor/air compressor/air cartridge that can be used as the pressure source for the invention of FIG. 1A.

FIG. 1D shows a mechanical air pump that can be used with the invention in FIG. 1A.

DESCRIPTION OF THE PREFERRED EMBODIMENT

Figure 2:
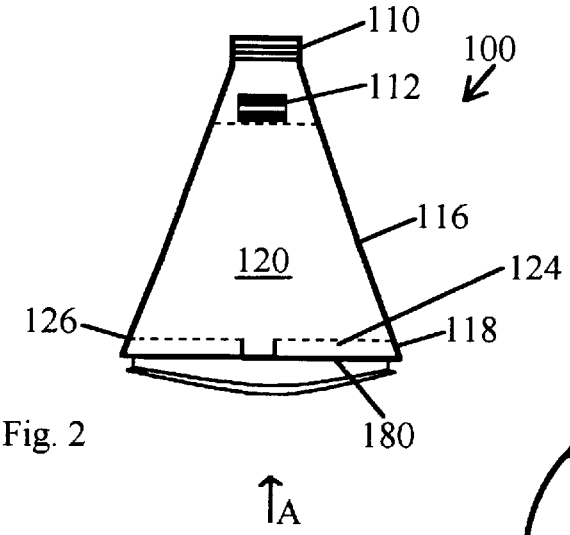
FIG. 2 is a side view of the appended shroud attachment for the main body of FIG. 1A.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIG. 1A is a side view of the main body 1 of the novel feces dispersal device of the subject invention. FIG. 1B is a top view of the main body 1 of FIG. 1A along arrow B. FIG. 1C shows an electrical compressor/air compressor pressurized air source 50 that can be used with the novel device 1 of FIG. 1A. FIG. 1D shows a mechanical air pump 70 that can be also used to pressurize the device 1 of FIG. 1A.

Referring to FIGS. 1A–1D, device 1 includes an elongated hollow cylindrical container portion 20, a top inwardly curving portion 21, and a bottom inwardly narrowing portion 29. Device 1 can have a capacity of approximately 1.5 to approximately 3.0 liters and have a length of approximately 12 to approximately 18 inches, and be formed from a composite material such as hardened plastic, fiberglass, aluminum, stainless steel, and the like. A insulating jacket 40 such as insulated nylon, Styrofoam, and the like, can be wrapped about device 1 to insulate if hot or cold liquid contents are stored therein. A flexible shoulder strap 34 connected at ends 27 to the sides on cylindrical body 20 allows device 1 to be easily portable. On top portion 21 is a fillport 22 having a screwable tethered type cap, which allows chamber 20 to be filled with liquid such as water, and the like, therein. Also on top portion 21 can be cartridge ports 18 which allow the inside of cylinder 20 to be pressurized by air sources 50 such as $CO_2$ cartridges, air cylinders, electrical compressors, and the like, shown in FIG. 1C. Device 1 can also be pressurized by a nipple inlet pressurization valve 23 such as those found on conventional tire tubes and the like. Valve 24 connects to the inside of cylinder 20 by way of a cylinder pressure line 19. A handle topped mechanical air pump 70 shown in FIG. 1D having a female air valve tip 75 can mateably attach to nipple valve 24 of device 1. Alternatively, mechanical pump 70 can be foot pumped. Nipple valve 24, and switch 28 can be mounted about a center bar 36 having cavities 25 on both sides thereof, so that a user can insert there fingers through the cavities 25 to grasp about bar 36 in a pistol type grip in order to support and lift device 1.

Referring to FIGS. 1A–1C, mechanical activation switch 28 such as a toggle switch and the like, uses a pressurized activation line 26 to open and close a nozzle valve 30 allowing pressurized liquid within chamber 20 to be released through nozzle 32. Valve 30 can be spring loaded closed and opens at approximately 5 psi or greater from line 26 so as pressure depletes in line 26, the valve 30 closes. Threads 39 can be on the exterior of nozzle end for connecting device to the conical shroud 100 of FIGS. 2–3.

Figure 3:
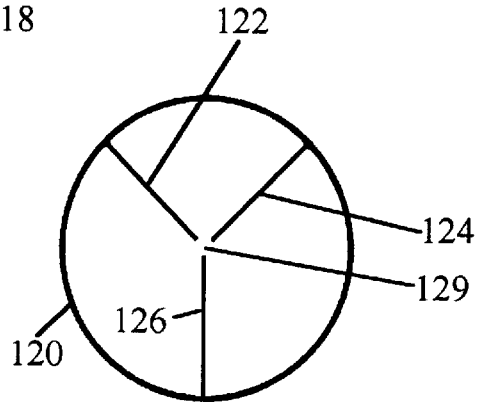
FIG. 3 is a bottom view of the shroud attachment of FIG. 2 along arrow A.

FIG. 2 is a side view of the appended shroud attachment 100 for use with the main body 1 of FIG. 1. FIG. 3 is a bottom view of the shroud attachment 100 of FIG. 2 along arrow A. Shroud attachment 100 can have a conical horn shape 116 with a hollow interior portion thereof. Conical attachment can have a length of approximately 3 to approximately 5 inches, and a large diameter bottom of approximately 3.5 to approximately 5 inches. A flexible bendable and expandable accordion like joint 110 can fit about nozzle 32 of the device 1 of FIG. 1A, and allows the nozzle end 32 of device 1, to be pivoted up to approximately 30 degrees from the vertical and up to 360 degrees in the horizontal while maintaining a stationary and vertical spray positions. On the inner walls of nozzle end 110 can be interior threads which mateably rotate and connect to threads 39 on nozzle end 32 of the device 1 of FIG. 1A. A pressure vent flap 112 opens to the inside of cone 100 when nozzle end 32 of the device 1 is inserted therein. Pressure relief vent flap 112 on the exterior side of cone 100 allows for pressure venting to prevent bottom end 120 of conical attachment 100 from "lifting off" upon device activation. Flap 112 can be flexible and have a slit like opening with or without a shielding flap to direct vented pressure down the outside of the cone 100. Three flange rods 122, 124 and 126 inside the lower interior of cone 100 cross over the bottom open end 120 of the cone 100 to within approximately 0.5 inches of cone centerpoint 129. Cap cover 180 can snap over and cover opening 120 when shroud 100 is not being used. Shroud 100 can also be disconnected from device 1 for cleaning purposes.

Figure 4:
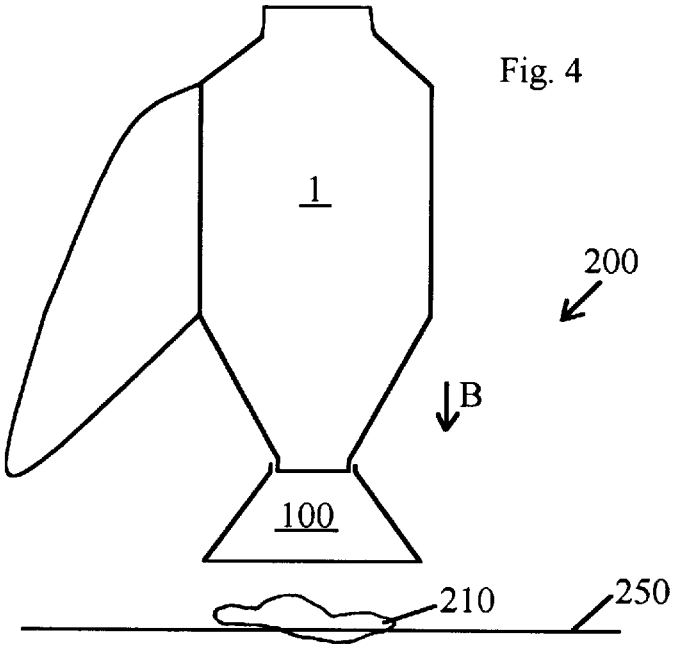
FIG. 4 shows a preferred use of positioning the novel device of the preceding Figures over a clump material that is to be liquified and dispersed into an earth ground surface.

FIG. 4 shows a preferred use 200 of positioning the novel device 1 and cone 100 of the preceding figures over a clump material that is to be liquified and dispersed into an earth ground surface such as a lawn and garden. The operation of devise 1 and cone 100 will now be described.

Referring to FIGS. 1A–1C, and 2–4, liquid such as water with or without a disinfectant agent, can be poured through fillport 22 to fill the inside of chamber 20. Cap 22 is screwed onto the fillport, and then either a handpump air source 70 of FIG. 1C, or a nonmechanical pressurized source 50 is connected to respective valves 18, 24 to pressurize the contents of chamber 20. The inside of chamber 20 can be pressurized to approximately 75 pounds per square inch (psi). Device 1 with attached conical shroud 100 can be positioned in the direction of arrow B over a clump material 210 so that flange rods 122, 124, 126 mash into and separate clump material 210. With the bottom end 120 of conical attachment flush against the ground 250, mechanical switch 28 is activated allowing pressurized liquid to be sprayed into conical attachment 100 liquifying the separated clump materials 210, and dissolves the remnant materials into the ground. The nozzle tip end 32 can be rotated to adjust the spray pattern from a narrow beam to a spread out pattern. The flange rods 122, 124, 126 can be cleaned by raising the device 1 with shroud off the ground and releasing pressurized fluid through the shroud 100 while the invention is suspended in the air.

The preferred invention shown in FIG. 1A can also be sized large enough (up to several feet in length) elongated size so that a user would not have to crouch and bend down.

The device has special applicability when used over earth ground surfaces, such as lawns, and the like, where the liquified remnants are dispersed into the ground.

While the preferred embodiment is described be used with pressurized water, other types of liquids can be used such as but not limited to cleaning fluids, disinfectants, soapy water, cleaning fluids, insecticide liquids, anti-bacterial fluids, fragrances, and the like.

Although the preferred embodiment describes using the invention for feces, the invention can be applied to breaking up other types of undesirable clump materials from ground surfaces such as bird droppings, mud, and the like.

While the preferred embodiment describes using the novel device over earth ground surfaces, other surfaces can also be used such as but limited to pavement, concrete, slate, sand, shell, stone beds, wood chip beds, granular surfaces, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A portable apparatus that is hand carriable for breaking up and liquefying clump material, comprising in combination:

a main chamber for housing a pre-pressurized liquid having an exit port;

activation means on the main chamber for releasing the pre-pressurized liquid from the chamber;

a shroud cover having a narrow upper open end connected to the exit port of the main chamber, and a lower expansive open end for fitting over and covering clump material located on a ground surface;

means to adjust the narrow upper open of the shroud cover so that the shroud cover can pivot and bend relative to the main chamber; and a nozzle connected to the narrow upper end of the shroud cover for directing the released pressurized fluid through the narrow open end of the shroud cover and out the lower expansive open end to liquify and break the up clump material located on the ground surface, wherein the chamber shroud, adjust means and nozzle together as a single unit are hand carriable to remote sites and the adjust means adjusts the direction of the released pressurized fluid for optimum dispersion of the clump material.

2. The portable apparatus of claim 1, wherein the main chamber further comprises:

an inlet port for refilling the chamber with unpressurized liquid.

3. The portable apparatus of claim 2, wherein the inlet port includes:

a removable external cap.

4. The portable apparatus of claim 1, further comprising:

a shoulder strap connected to the main chamber for allowing the apparatus to be carried on one's shoulder.

5. The portable apparatus of claim 1, further including:

a fill valve attached to the main chamber for allowing the main chamber to be pressurized by an outside pressure source.

6. The portable apparatus of claim 5, wherein the outside pressure source includes:

a mechanical pump.

7. The portable apparatus of claim 5, wherein the outside pressure source includes:

a nonmechanical power source chosen from one of:

an electrical compressor, and compressed air cylinders.

8. The portable apparatus of claim 1, wherein the nozzle further includes:

means for adjusting the nozzle to release the pressurized liquid into selected spray patterns.

9. The portable apparatus of claim 1, wherein the shroud includes:

a cone shape.

10. The portable apparatus of claim 1, wherein the top narrow end of the shroud includes:

threads for mateably rotating to matching threads on the nozzle.

11. The portable apparatus of claim 1, wherein the shroud includes:

a cross member inside the shroud adjacent to the expansive open end, the cross member being used to separate the clump material.

12. The portable apparatus of claim 11, wherein the cross member includes:

three rods having one connecting to another rod, and opposite ends connected about a perimeter inside the shroud.

13. The portable apparatus of claim 1, wherein the clump material includes:

waste material chosen from animal feces and bird droppings.

14. The portable apparatus of claim 1, wherein the clump material includes:

mud material.

15. The portable apparatus of claim 1, wherein the adjust means include:

a flexible bendable and expandable accordion portion.

16. A method of mashing and dispersing clump material with a portable pressurized device, comprising the steps of:

(a) carrying a portable chamber having a pre-pressurized liquid within the portable chamber, the chamber having a lower end that is both moveably and pivotably attached to an upper narrow end of a shroud, the shroud having an open expansive bottom end;

(b) adjusting position and angle of the open expansive bottom end of the shroud over clump material to encase clumped material on a ground surface;

(c) separating the clump material into plural pieces within the shroud;

(d) releasing the pressurized liquid from the chamber into the shroud to disperse the separated clump material into the ground surface; and (e) varying the position and the angle of the expansive bottom end of the shroud cover in order to adjust the direction of the released pressurized fluid for optimum dispersion of the clump material.

17. The method of mashing and dispersing clump material of claim 15, wherein the clump material includes:

waste material chosen from animal feces and bird droppings.

18. The method of mashing and dispersing clump material of claim 15, wherein the clump material includes:

mud material.

19. The method of mashing and dispersing clump material of claim 15, wherein the pivotally positioning and angling step further includes:

a flexible bendable and expandable accordion portion.

* * * * *